US005181449A

United States Patent [19]

Winandy

[11] Patent Number: 5,181,449

[45] Date of Patent: Jan. 26, 1993

[54] TATTING SHUTTLE WITH DISPOSABLE BOBBIN

[76] Inventor: Carol M. Winandy, 1295 Des Plaines Ave., P.O. Box 1401, Des Plaines, Ill. 60018

[21] Appl. No.: 928,685

[22] Filed: Aug. 12, 1992

Related U.S. Application Data

[63] Continuation of Ser. No. 675,283, Mar. 26, 1991, abandoned.

[51] Int. Cl.[5] ..... D04C 7/00

[52] U.S. Cl. ..... 87/58; 242/85.1

[58] Field of Search ..... 87/58, 59; 242/85.1

[56] References Cited

U.S. PATENT DOCUMENTS

| | | | |
|---|---|---|---|
| 1,452,183 | 4/1923 | Carlson | 87/58 |
| 1,453,639 | 5/1923 | Richardson | 87/58 |
| 1,521,528 | 12/1924 | Grigg | 87/58 |
| 2,366,568 | 1/1945 | Silliman | 87/58 |
| 2,469,291 | 5/1949 | Cisneros | 87/59 |

FOREIGN PATENT DOCUMENTS

| | | | |
|---|---|---|---|
| 84890 | 5/1920 | Switzerland | 87/58 |

OTHER PUBLICATIONS

Six-page brochure subtitled "Specializing In Tatted Lace Making," and including price lists for 1989-1990.

Six-page brochure entitled "New, Exciting Original Kits and Patterns From TATSY," bearing a copyright notice dated 1982.

Seventeen page catalog identified as "Catalog 4," bearing a copyright notice of 1982.

A copy of a two-page brochure regarding items offered for sale by the inventor of the present invention.

*Primary Examiner*—Joseph J. Hail, III

*Attorney, Agent, or Firm*—Fitch, Even, Tabin & Flannery

[57] ABSTRACT

Tatting shuttle apparatus includes a pair of releasably interconnected side members with interlocking posts about which tatting thread may be wound. The posts may also receive a bobbin held captive between the side members. The botton has a core of elongated cross-section to increase thread capacity for a shuttle of a traditional size and shape.

6 Claims, 3 Drawing Sheets

FIG.1
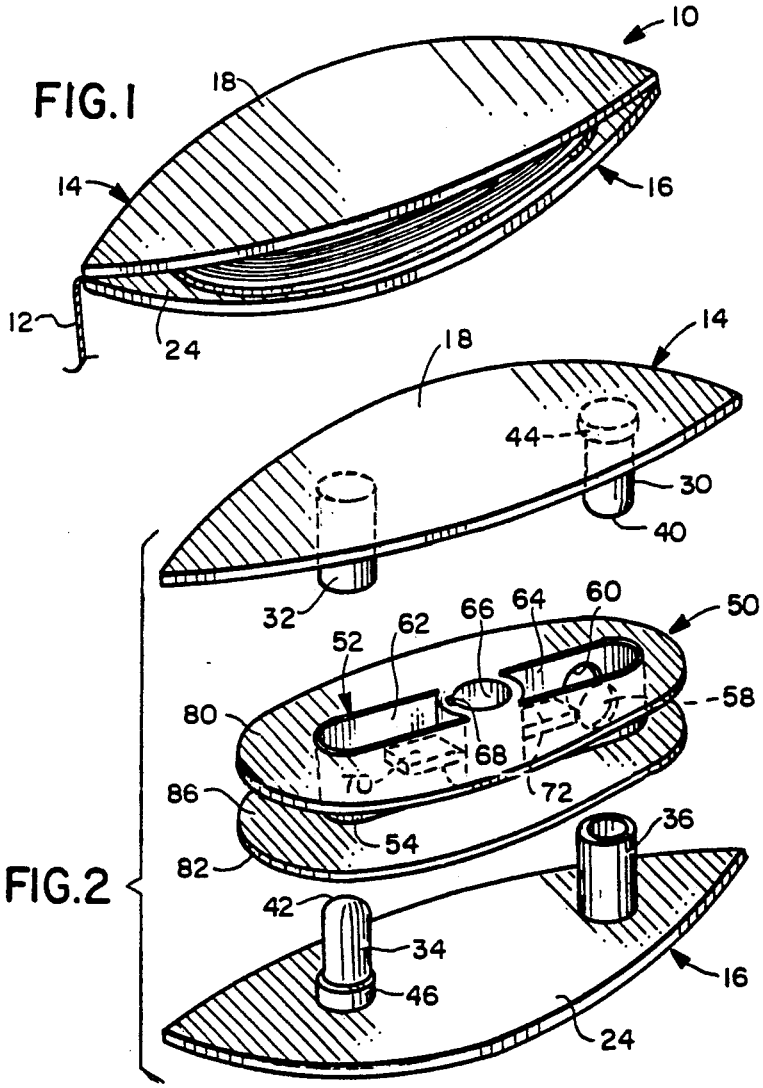
FIG.2
FIG.3
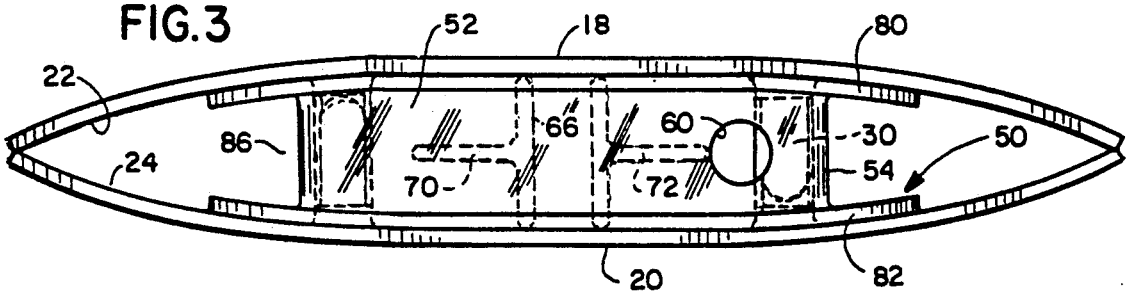

TATTING SHUTTLE WITH DISPOSABLE BOBBIN

This application is a continuation division, of application Ser. No. 07/675,283 filed Mar. 26, 1991 now abandoned.

FIELD OF THE INVENTION

The present invention is directed to an apparatus for providing a tatting shuttle with a disposable bobbin. More particularly, the present invention is directed to a tatting shuttle having an inexpensive disposable bobbin for engagement in a shuttle supplied by the manufacturer of the tatting thread.

BACKGROUND OF THE INVENTION

Tatting is generally a very unique style of stitching which requires a special tatting shuttle. Further, tatting is the art of making very delicate handmade lace, as for edging, insertions or doilies, formed usually by looping and knotting thread. The general tatting shuttle has two bow-like side members assembled in a manner to form a unique shaped shuttle which has the ability to carry thread in a compact manner through loops enabling precise knot tying. The shuttle carries the yarn through the loop in a compact manner, reducing the time necessary to make the loops and tie the knots. The shuttle additionally prevents unnecessary knots and tangles.

Generally, at each end of the shuttle is a narrow point like configuration which has a narrow gap for yarn to pass between. Yarn is generally wound around the shuttle's interior center posts. In order to wind the yarn, the yarn is forced through the narrow gap. This winding of the yarn generally causes wear on the yarn due to abrasion as the yarn passes between the closely spaced side members. The abrasion weakens the yarn and destroys appearance characteristics of the yarn due to fraying. The fraying also weakens the yarn which in turn weakens the stitching and durability of the tatting article.

Further, the winding of the yarn requires considerable time to pull the yarn through the narrow gap and to wind the yarn in a manner which precludes tangles and knots. The winding can also cause cuts on the fingers and this is especially true when the yarn is of small thickness. The size of the tatting shuttle also limits the amount of yarn which can be wound on the center posts. The size limitation requires that yarn be refilled at some time during the tatting of an article. Additionally, different color yarn or size yarn is desired for a particular job, and the yarn needs to be quickly changed. This change requires that either the yarn on the tatting shuttle be completely replaced, or that two or more tatting shuttles be employed. Many times, it is not practical or possible to carry, multiple tatting shuttles because of cost or convenience reasons. Furthermore, the changing and refilling of the yarn takes time away from the tatting procedure. However, if the yarn change was not as tedious tatters could change yarn more frequently and still accomplish a project in a given time, in order to make more colorful and appealing tatting articles.

It is a known practice to provide tatting shuttles with detachable bobbins. However, larger bobbins have been sought without increasing the size of the tatting shuttle. Also, it is desirable to provide a tatting shuttle which can be used with or without a bobbin.

SUMMARY OF THE INVENTION

It is an object of the present invention to provide a tatting shuttle and bobbin which can be inexpensively fabricated from a minimum number of inexpensive parts.

An additional object of the present invention is to provide a tatting shuttle having increased bobbin capacity and which has established and accepted characteristics including the shape and size of prior established tatting shuttles.

These and other objects will become more apparent from the following Detailed Description and Drawings are provided in a tatting shuttle apparatus having a pair of opposed working ends, comprising:

at least two removable side members;

a bobbin carried by the removable side members comprising a cylindrical core wall of elongated cross section and having flanges on each side of the core wall and extending beyond the core wall; and securement means for removably securing said side members on either side of said bobbin.

BRIEF DESCRIPTION OF THE DRAWING

The present invention will be described in connection with the accompanying drawings which illustrate the preferred embodiments and details of the invention; and in which:

FIG. 1 is a perspective view of a tatting shuttle embodying principles of the present invention, having a detachable bobbin;

FIG. 2 is an exploded perspective view thereof;

FIG. 3 is an elevational view thereof;

DETAILED DESCRIPTION OF THE PREFERRED EMBODIMENT

Figure 4:
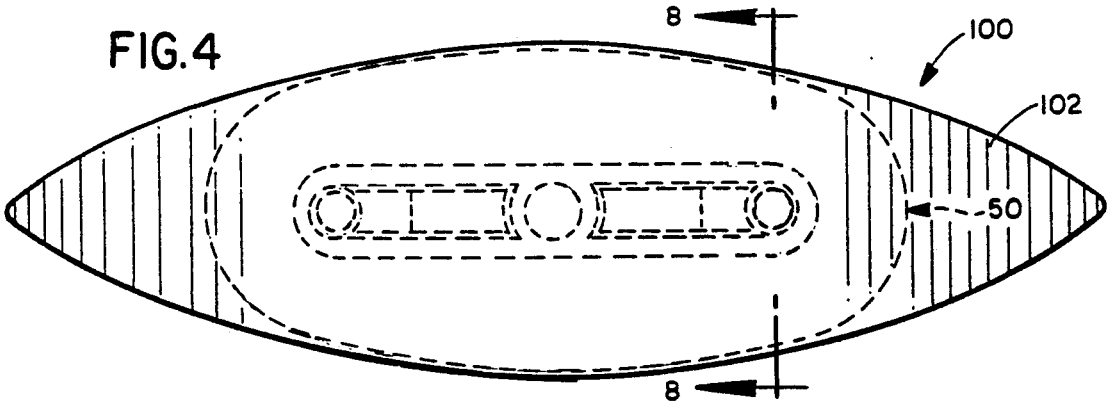
FIG. 4 is a plan view of an alternative embodiment of a shuttle apparatus.
Figure 5:
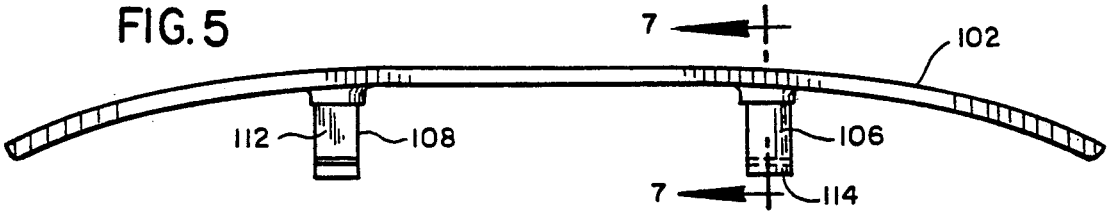
FIG. 5 is an elevational view of a side member thereof.
Figure 6:
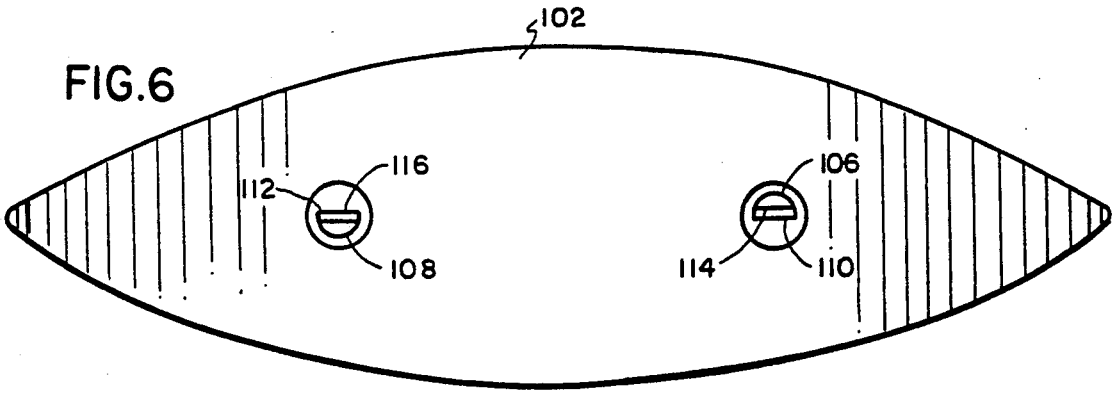
FIG. 6 is a plan view of the side member of FIG. 5.
Figure 7:
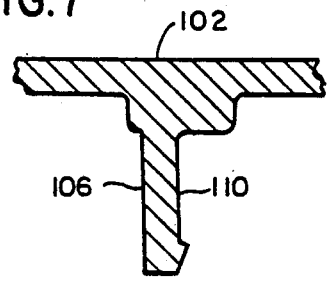
FIG. 7 is an enlarged fragmentary cross-sectional view taken along the line 7—7 of FIG. 6.

Referring now to the drawings, and initially to FIGS. 1-3, a first embodiment of tatting shuttle apparatus according to principles of the present invention is generally indicated at 10. As will be seen herein, the shuttle apparatus comprises releasably interlocked parts which may be readily reconfigured to either include or omit a coil form or bobbin for carrying the tatting thread 12. Apparatus according to the present invention has internal components configured so as to permit the outside surfaces to have a conventional size and shape. The shuttle apparatus 10 has generally ovoid side members 14, 16 having generally convex external surfaces 18, 20, respectively. The side members preferably have a generally uniform thickness throughout, and therefore preferably have generally concave interior surfaces 22, 24, respectively.

The side members 14, 16 are releasably interconnected and may easily be separated in the manner illustrated in FIG. 2. Each side member carries a pair of interlocking means or posts for telescopic interfitting with the corresponding posts of the opposing side member. For example, the side member 14, (as can be seen in FIG. 2) carries solid and hollow posts 30, 32, respectively. The opposing side member 16 carries a similar pair of solid and hollow posts 34, 36, respectively. The solid posts 30, 34 of the side members preferably have a rounded free end or tip 40, 42, respectively for ready insertion in hollow posts 36, 32, respectively, the rounded ends guiding the solid posts into the hollow posts for ready insertion without need for an accurate alignment. As can be seen in FIG. 2, the hollow posts 30, 34 include raised shoulders 44, 46, respectively to limit insertion in the hollow posts so as to allow a user to readily attain a desired spacing between the side members to attain certain advantages as will be described herein.

FIG. 2 illustrates an assembly including a coil form or bobbin generally indicated at 50, which is held captive between the side members in a manner to be described herein. The bobbin 50 includes a central wall or core 52 which has a cross-section which is elongated, generally comprising a "racetrack" or rectangle with rounded ends. Thus, although the core 52 is cylindrical, it does not have a right circular cylindrical configuration. The outer surface 54 of core 52 is smooth and generally continuous, except for a pair of aligned through-holes 58, 60 through which the leading end of thread to be wound on the bobbin may be threaded and tied about one end of the core prior to winding, especially a hand winding of thread on the bobbin. The core of the bobbin is dimensioned so as to lie outside of the posts of the side members, as is the radially inner extent of the flanges.

The interior surface of core 52 is interrupted by a cylinder 66 which divides the central opening of bobbin 50 into mirror image portions 62, 64. The cylinder 66 has a key way 68, to facilitate machine winding of bobbin 50. A pair of cantilevered walls or wings 70, 72 extend from cylinder 66 along a midplane thereof, as can be seen in FIG. 3. As can be seen in FIGS. 2 and 3, the wings 70, 72 are spaced from the rounded ends of interior wall surfaces of cavities 62, 64.

Bobbin 50 includes a pair of flanges 80, 82 which have an elongated shape, which may be described generally as a "racetrack" or rectangle with rounded ends. As can be seen in FIG. 3, the flanges 80, 82 preferably have a generally constant thickness throughout. Preferably, the flanges are not planar, but rather have convex outer surfaces for intimate nesting engagement with the concave inner surfaces 22, 24 of side members 14, 16, respectively. The flanges 80, 82 extend well beyond the core 52, so as to provide a channel or a cavity 86 for receiving thread wound on the bobbin. With regard to the cavity 86, limitations on its thread-receiving capacity are imposed by the converging ends of the flanges, which lie along the major axes thereof, and which are inclined toward one another as can be seen in FIG. 3. As can be seen in FIG. 3, encroachment of the flange ends into cavity 86 is minimal, and thus does not significantly detract from a cavity volume defined by flat or planar flanges. As can now be seen, the present invention provides a bobbin suitable for machine winding by a commercial thread manufacturer of optimally large capacity and which can be quickly and easily loaded between releasably interlockable side members to form a shuttle apparatus of traditional size and shape.

Referring now to FIGS. 4–8, an alternative shuttle apparatus is generally indicated at 100 and is generally identical to shuttle apparatus 10, except for the configuration of the releasably interlocking posts of the side members. For example, the shuttle apparatus 100 has side members 102 which are of similar size and shape to the side members of apparatus 10. Apparatus 100, as can be seen in FIG. 4, carries bobbin 50 in the same manner illustrated above with reference to FIGS. 1–3.

The locking posts 106, 108 carried on side members 102 generally comprise semi-cylinders with flat surfaces 110, 112, respectively. The locking posts have enlarged free ends 114, 116 which cam across one another in a manner indicated in FIG. 8, to provide an interlocking which opposes incidental tension forces which tend to separate a mated pair of side members.

Figure 8:
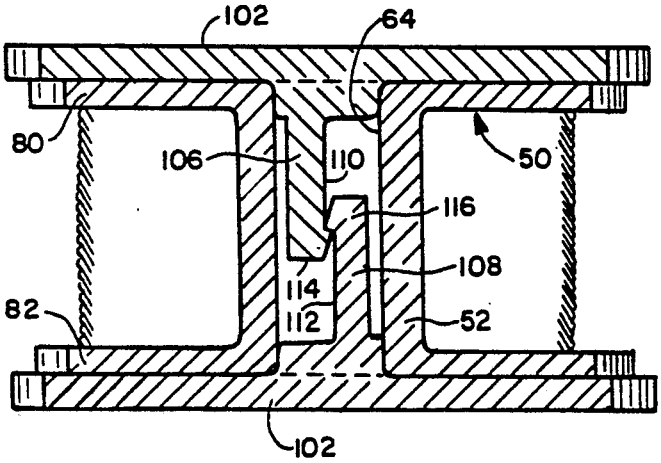
FIG. 8 is an enlarged cross-sectional view taken along the line 8—8 of FIG. 4.
Figure 9:
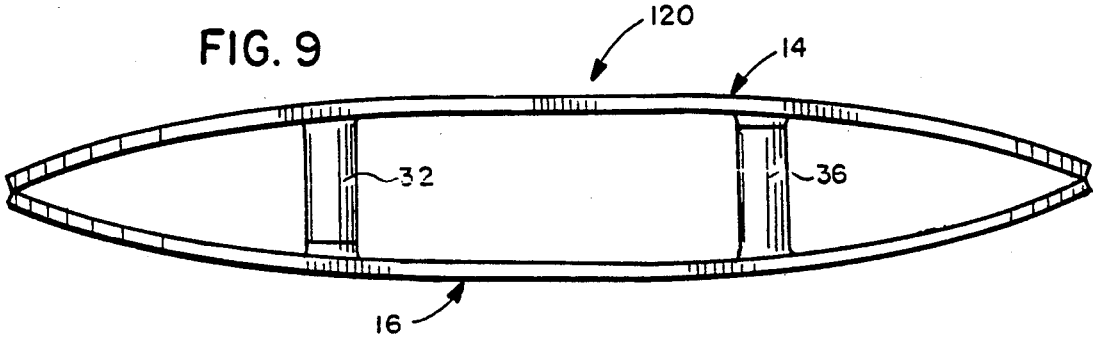
FIG. 9 is a perspective view of an alternate embodiment of a tatting shuttle in accordance with principles of the present invention.
Figure 10:
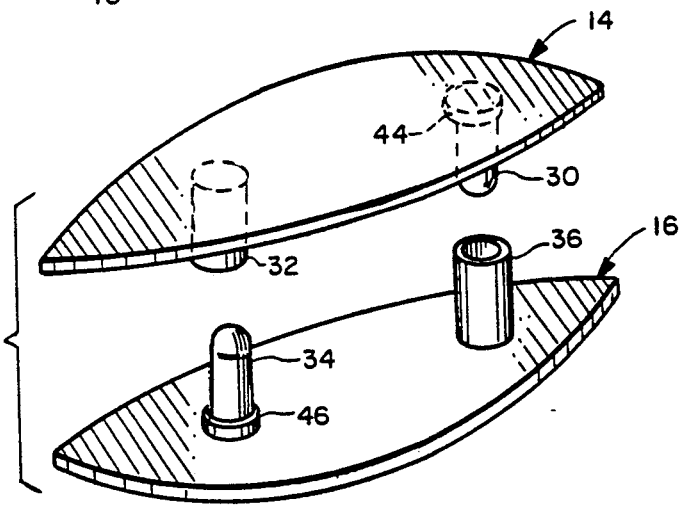
FIG. 10 is an exploded perspective view of the tatting shuttle of FIG. 9.
Figure 11:
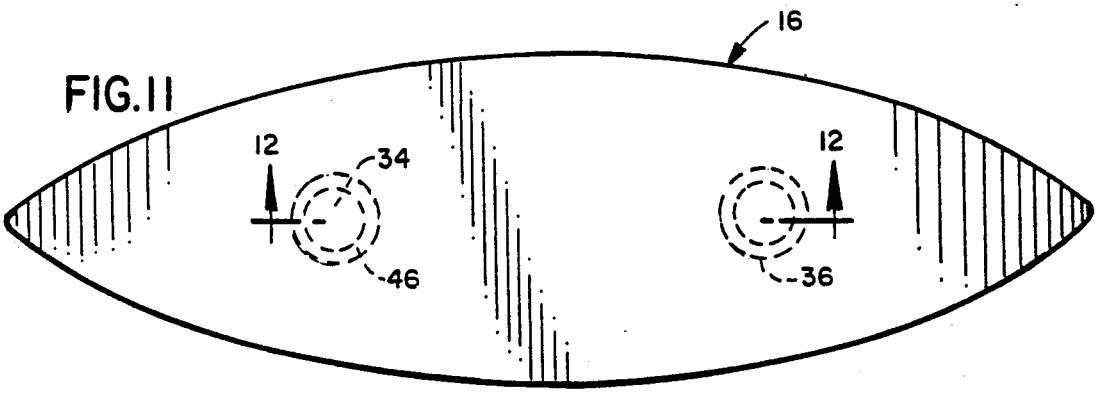
FIG. 11 is a plan view showing the interior of a side member of the tatting shuttle of FIG. 9.
Figure 12:
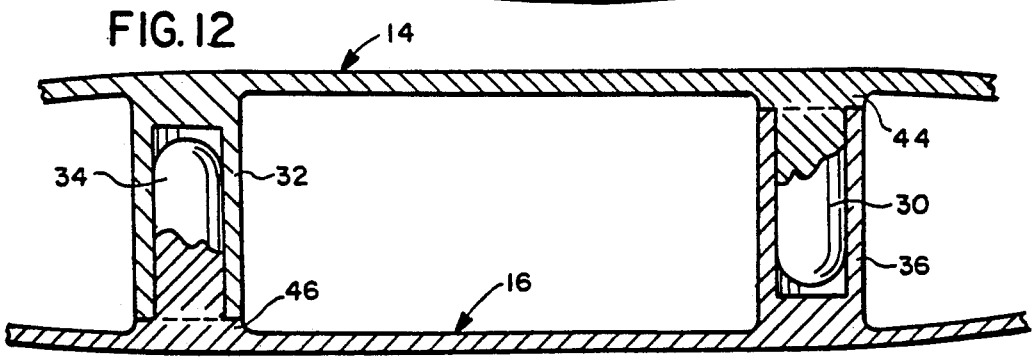
FIG. 12 is a fragmentary cross-sectional view taken along the line 12—12 of FIG. 11.

Referring now to FIG. 8, the mating posts 106, 108 of opposed side members 102 have interlocked, enlarged free ends 114, 116 which have cammed across one another when the side members are snapped together. As can be seen in FIG. 8, the interlocking posts 106, 108 are confined at their enlarged base portions by core 52, thus supporting the locking posts at their respective bases, so that resilient cantilever forces can be developed for the locking engagement. However, as will be appreciated from studying FIG. 6, for example, provision must be made to prevent relative displacement of the side members along their major axes. By locating the locking posts immediately adjacent the rounded ends of core 52, such displacement of the locking post is effectively prevented. If desired, one of the locking posts 106 or 108 can be disposed within a surrounding hollow cylinder integrally formed with the side member to receive the mating locking post and to eliminate the need for a bobbin to confine the locking post against unintentional or inadvertent separating movements. The outer surrounding cylinder must, of course, be large enough to accommodate the lateral deflection of the locking posts, as resilient cantilever forces are developed when the enlarged free ends are cammed over one another.

With reference now to FIGS. 9–12, another embodiment of the shuttle apparatus illustrating principles according to the present invention is generally indicated at 120. The shuttle apparatus is generally identical to apparatus 10 described above with reference to FIGS. 1–3, except for the omission of a bobbin. According to one aspect of the present invention, a preferred form of the shuttle apparatus permits a user to load thread without use of a bobbin. Previously, side members of tatting shuttles were permanently secured together using adhesive or the like. With the present invention, the side members are separably connected one with another and a user can secure the leading end of a thread to be loaded in the apparatus by tying a loop in the thread and inserting the loop over a locking post, such as the hollow post 32 or 36.

With the side members then interconnected, the thread loop is held captive to facilitate a winding of thread on the apparatus. It is important to secure the leading end of a thread to be wound on the apparatus, since tatting shuttles according to the present invention pinch the thread as the thread is passed between the pointed tips of the side members. That is, it is preferred that the pointed tips of the side members be closely spaced or touching one another to impart a friction release to thread passed between the side members during an unwinding operation, as is customary with traditional tatting shuttles. In order to insure such close tolerance arrangements between mated side members, it is generally preferred that at least one locking post of each mated pair be provided with an enlarged base or shoulder, such as the shoulders 44, 46 visible in FIG. 12, to provide a convenient, tactile indication that mating of the side members has been completed in a desired manner. These features, along with the ability of a user to secure a thread in the apparatus by slipping a loop over a locking post before mating helps users with impaired eyesight to more fully enjoy operation of the tatting apparatus.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A tatting shuttle apparatus having a pair of opposed working ends, comprising:

at least two removable side members;

a bobbin carried between the removable side members, comprising a core wall having opposed, spaced convexly curved portions joined together by generally straight line portions, so as to define a hollow interior cavity, and so as to impart an elongated cross-section to the core wall, the bobbin further having a pair of spaced apart flanges, one flange adjacent each side member, and extending beyond the core wall;

said bobbin further comprising a hollow cylinder for rotatable mounting of the bobbin during winding, which divides said cavity into two portion; and securement means for removably securing said side members on either side of said bobbin.

2. The apparatus in accordance with claim 1 wherein the side members have pointed ends which converge toward one another to form a gap at each end of the shuttle for pinching engagement with thread unwound from said bobbin.

3. The apparatus in accordance with claim 1 wherein the securement means comprises post means extending from each side member through the bobbin core wall and toward the other side member for locking engagement therewith.

4. The apparatus of claim 1 wherein the side members and the bobbin flanges have opposed concave interior surfaces.

5. The apparatus 1 wherein said hollow cylinder defines a keyway to assist in winding thread on the bobbin.

6. The apparatus of claim 1 further comprising a pair of wings extending from said hollow cylinder, one wing extending into each cavity portion.

* * * * *